US005133141A

United States Patent [19]

Bane

[11] Patent Number: 5,133,141

[45] Date of Patent: Jul. 28, 1992

[54] VEHICLE REARVIEW MIRROR COVER

[76] Inventor: James K. Bane, Rte. 2, Box 275, Carthage, Tenn. 37030

[21] Appl. No.: 729,241

[22] Filed: Jul. 12, 1991

[51] Int. Cl.[5] ..... G09F 21/04

[52] U.S. Cl. ..... 40/593; 40/591

[58] Field of Search ..... 40/593, 591, 307, 311, 40/323

[56] References Cited

U.S. PATENT DOCUMENTS

| | | | |
|---|---|---|---|
| 1,820,788 | 8/1931 | Failing | 40/591 X |
| 1,910,503 | 5/1933 | Schollmeyer . | |
| 1,927,913 | 9/1933 | Bennett | 40/593 X |
| 2,182,275 | 12/1939 | Blonkvist | 40/593 X |
| 4,915,488 | 4/1990 | Lambert et al. | 350/277 |
| 4,974,355 | 12/1990 | Abrams | 40/591 |

FOREIGN PATENT DOCUMENTS 566213 4/1958 Belgium .

*Primary Examiner*—Laurie K. Cranmer
*Assistant Examiner*—Milton Nelson, Jr.
*Attorney, Agent, or Firm*—Sughrue, Mion, Zinn, Macpeak & Seas

[57] ABSTRACT

A vehicle rearview mirror cover or sock is formed of a stretchable or flexible material and is adapted to be snugly fitted on the reverse side of an interior vehicle rearview mirror. Indicia, etc. such as a trademark, service mark, name, logo, emblem, or the like may be disposed on the back of the cover so as to be easily viewed from the front area of the vehicle. Also, the cover may be left a solid color without indicia in order to change the color of the reverse side of the mirror.

4 Claims, 1 Drawing Sheet

VEHICLE REARVIEW MIRROR COVER

BACKGROUND OF THE INVENTION

My invention provides a vehicle rearview mirror cover or sock which is aesthetically pleasing to the eye and which may include, indicia, etc. on the cover's back surface facing toward the front of the vehicle. The cover is made of an elastic or flexible material so that it is held in place on the mirror by stretching or flexing the cover over the edges of the mirror.

In general, it is known to hang a printed card on the rearview mirror support of a vehicle. For example, U.S. Pat. No. 4,974,355 (Abrams) discloses a sign for hanging on a vehicle rearview mirror. The hanger sign has indicia, e.g., an advertising message, on the rear of the sign facing the front of the vehicle. However, the sign of Abrams hangs from the rearview mirror support.

The Belgian Patent No. 566,213 discloses a vehicle rearview mirror having a document 27 which faces the front of the vehicle. However, the mirror and the document are disposed as an integral unit (see FIGS. 3 and 4).

U.S. Pat. No. 4,915,488 (Lambert et al.) discloses a mirror shade screen which is stretched over the edges of the mirror as seen in FIGS. 1–3. However, the mirror shade screen of Lambert et al. is designed for use on an outside rearview mirror of an automotive vehicle for night driving to reduce the intensity of light reflected into the driver's eyes from following vehicles.

U.S. Pat. Nos. 1,820,788 (Failing) and 1,910,503 (Schollmeyer) are of background interest with respect to the present invention.

SUMMARY OF THE INVENTION

It is an object of the present invention to provide a vehicle rearview mirror cover or sock which is formed of a stretchable or flexible material and which is designed to fit snugly and tightly on the reverse side of a vehicle rearview mirror with no free swinging play whatsoever, so as to be easily viewed from the front area of the vehicle. A trademark, service mark, name, logo, emblem, etc. may be disposed on the back of the cover or sock in order to promote universities, college or professional sports, amusement parks, retailers and others.

Alternatively, the mirror cover may be formed of a particular color, without indicia, in order to change the color of the reverse side of the rearview mirror for aesthetic purposes.

In particular, the mirror cover includes a body formed of a stretchable or flexible material and has a concave shape with a back surface and an opening or socket which is adapted to receive the vehicle rearview mirror, the body having substantially the same contour as the rearview mirror so as to be snugly fitted over the reverse side of the mirror. Further, indicia may be disposed on the back surface of the cover so as to be easily viewed from a front area of the vehicle.

BRIEF DESCRIPTION OF THE DRAWINGS

Other features and advantages of the present invention will be apparent from the following description taken in connection with the accompanying drawings wherein.

DETAILED DESCRIPTION OF THE PREFERRED EMBODIMENTS

Figure 1:
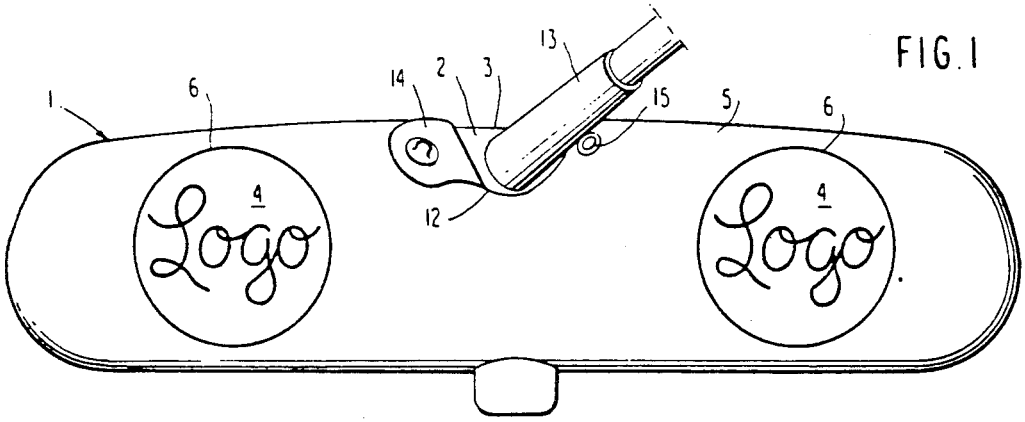
FIG. 1 is an enlarged rear view of the vehicle rearview mirror cover according to the present invention, disposed on a rearview mirror.
Figure 2:
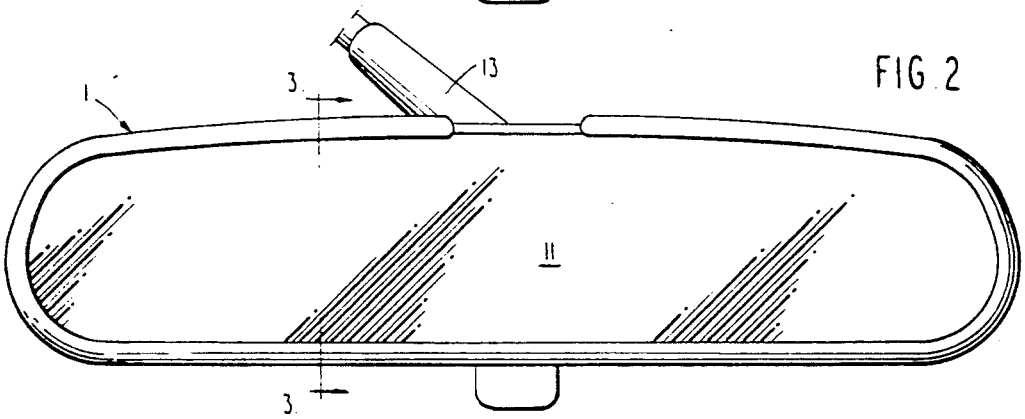
FIG. 2 is an enlarged front view of the vehicle rearview mirror and cover, with the reflective surface of the mirror in view.

The invention will now be described with reference to the drawings. As shown in FIG. 1, the vehicle rearview mirror cover or sock is generally denoted by the reference numeral 1. The cover 1 is formed of a stretchable, elastic or flexible material and is adapted to be slid over the reverse or back side 2 of the interior rearview mirror 3.

The cover may be formed of, for example, rubber, foam rubber, foam plastic, a flexible plastic, vinyl, cloth, etc. However, any elastic, stretchable, or flexible material may be used to form the cover 1.

Figure 5:
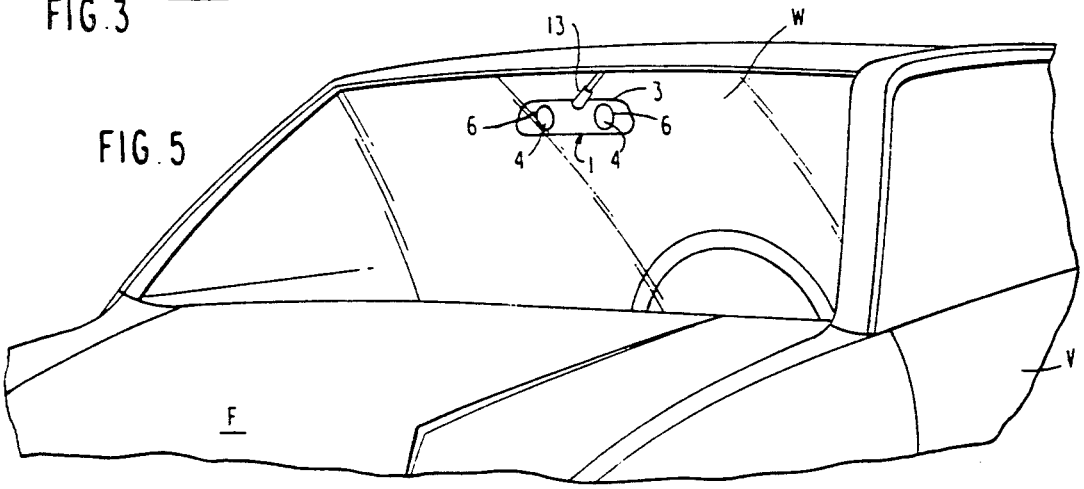
FIG. 5 is a perspective view of the vehicle rearview mirror cover according to the present invention, shown in use on the rearview mirror of an automotive vehicle.

As best seen in FIGS. 1 and 5, indicia, etc. 4 are disposed on the cover's back surface 5 facing toward the front F of the vehicle V. The indicia 4 may take the form of, for example, a trademark, a service mark, a name, an emblem or a logo. As seen in FIG. 1, the logo is located on a pair of circular members 6 which are attached to the cover's back surface. The indicia 4 could likewise be silk-screened on the cover 1 or formed directly in the cover 1.

Figure 3:
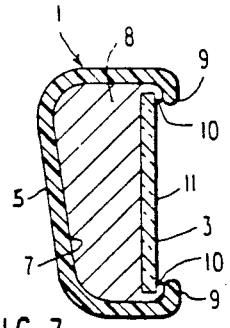
FIG. 3 is a cross sectional view of the mirror and cover of FIG. 2 along the lines 3—3.
Figure 4:
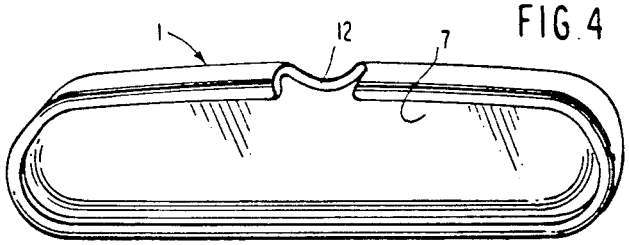
FIG. 4 is a perspective view of the vehicle rearview mirror cover alone prior to being fitted over the mirror.

As shown in FIGS. 3 and 4, the cover 1 is formed as a unitary, generally concave body having a back surface 5 and a socket 7 with substantially the same contour as the mirror 3 and for receiving the housing 8 of the mirror 3. The cover 1 may extend in the form of a lip 9 so as to overlap the front edge 10 of the mirror housing 8. The front edge 10 serves as a rim for holding in the reflective glass 11 of the mirror 3. The cover includes a notch 12 at the upper central portion thereof for accommodating the mirror support 13.

It is preferred that the cover 1 be molded from an elastic material so as to fit the contour of the rearview mirror and then silk-screened to add the desired logo, etc. However, the cover 1 could likewise be left a solid color with no indicia, or the indicia formed directly in the cover during molding thereof. If left a solid color without indicia, the cover then simply allows the user to change the color of the reverse side 2 of the rearview mirror. Of course, the cover would be available in a variety of colors.

In use, the socket or opening 7 of the mirror cover 1 is simply aligned with the reverse side 2 of the interior rearview mirror 3. The cover 1 is then slipped on the reverse side 2 of the mirror 3 by applying manual pressure to the back surface 5 of the cover 1 until the housing 8 of the mirror 3 is snugly received in the socket 7 of the cover.

The indicia are thus easily viewed through the vehicle windshield W from a front area of the vehicle V (see FIG. 5).

In lieu of or in addition to the snug fit of the cover 1, an adhesive backing may be disposed inside the socket 7 to ensure that the cover is tightly secured to the mirror.

In addition, a fastening flap 14 may be included to further secure the cover 1 to the mirror. The flap 14 simply extends around the front of the mirror support 13 and engages a retaining member 15.

With the above-described vehicle rearview mirror cover 1, the user is able to easily support their favorite university, business, etc. by simply slipping the cover on the reverse side of the vehicle rearview mirror. Likewise, the color of the reverse side of the mirror may easily be changed. Further, the mirror cover 1 may be produced and sold relatively inexpensively and is simple to put on and remove from the mirror.

It is contemplated that numerous modifications may be made to the vehicle rearview mirror cover of the present invention without departing from the spirit and scope of the invention as defined in the following claims.

What is claimed is:

1. In combination with an interior rearview mirror mounted within a passenger compartment of a vehicle, a vehicle rearview mirror cover; said interior rearview mirror comprising a reflective surface having a reverse side; and an elongated housing portion disposed on the reverse side of said reflective surface; said vehicle rearview mirror cover comprising:

a unitary, generally concave body formed of a stretchable or flexible material and including a back surface and a socket which receives said elongated housing portion on the reverse side of the reflective surface of said interior rearview mirror, said body being snugly fitted over said elongated housing portion of the interior rearview mirror to attendantly provide an aesthetically pleasing surface when said vehicle rearview mirror cover is viewed from a front area of the vehicle; and indicia means disposed on the back surface of said unitary, generally concave body of said vehicle rearview mirror cover, so as to be easily viewed form the front area of the vehicle.

2. The combination according to claim 1, wherein said indicia means comprise one of a trademark, a service mark, a name, a logo and an emblem.

3. The combination according to claim 1, wherein said indicia means are silk-screened on the back surface of said unitary, generally concave body of said vehicle rearview mirror cover after said vehicle rearview mirror cover is molded.

4. The combination according to claim 1, wherein said stretchable or flexible material is selected from the group consisting of rubber, foam rubber, foam plastic, flexible plastic, vinyl and cloth.

* * * * *